US011614257B2

(12) United States Patent
Zhou et al.

(10) Patent No.: US 11,614,257 B2
(45) Date of Patent: Mar. 28, 2023

(54) HOUSING ASSEMBLY FOR AIR HANDLING APPARATUS AND AIR HANDLING APPARATUS

(71) Applicants: GD MIDEA AIR-CONDITIONING EQUIPMENT CO., LTD., Foshan (CN); MIDEA GROUP CO., LTD., Foshan (CN)

(72) Inventors: Junhua Zhou, Foshan (CN); Wei Rao, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 363 days.

(21) Appl. No.: 16/801,475

(22) Filed: Feb. 26, 2020

(65) Prior Publication Data

US 2021/0164692 A1 Jun. 3, 2021

Related U.S. Application Data

(63) Continuation of application No. PCT/CN2019/125126, filed on Dec. 13, 2019.

(30) Foreign Application Priority Data

Nov. 29, 2019 (CN) ..... 201922129773.0
Nov. 29, 2019 (CN) ..... 201922131050.4
Nov. 29, 2019 (CN) ..... 201922131390.7

(51) Int. Cl.
*F24F 1/027* (2019.01)
*F24F 13/32* (2006.01)

(52) U.S. Cl.
CPC ..... *F24F 13/32* (2013.01); *F24F 1/027* (2013.01)

(58) Field of Classification Search
CPC ..... F24F 13/32; F24F 1/027
USPC ..... 454/204
See application file for complete search history.

(56) References Cited

U.S. PATENT DOCUMENTS 5,193,355 A * 3/1993 Matsumi ..... F24F 1/027 62/262
6,393,856 B1 * 5/2002 Gunji ..... F24F 13/082 62/298
2002/0144513 A1 * 10/2002 Gunji ..... F24F 1/0063 62/298
2017/0115028 A1 * 4/2017 Lee ..... F24F 8/10

* cited by examiner

*Primary Examiner* — Avinash A Savani
*Assistant Examiner* — Ryan L Faulkner
(74) *Attorney, Agent, or Firm* — Anova Law Group PLLC

(57) ABSTRACT

A housing assembly includes a face frame and a face plate. The face frame includes a main vent and a plurality of first snap joint members located at two opposite sides of the main vent. The face plate includes an air hole in communication with the main vent and a plurality of second snap joint members distributed at two opposite sides of the face plate and arranged centrosymmetrically. The plurality of second snap joint members are configured to be fitted with the plurality of first snap joint members in one-to-one correspondence.

19 Claims, 15 Drawing Sheets

A

HOUSING ASSEMBLY FOR AIR HANDLING APPARATUS AND AIR HANDLING APPARATUS

CROSS-REFERENCE TO RELATED APPLICATIONS

This application is a continuation of International Application No. PCT/CN2019/125126, filed on Dec. 13, 2019, which is based on and claims priority to Chinese Patent Application Nos. 201922131050.4, 201922131390.7, and 201922129773.0, all filed on Nov. 29, 2019, the entire contents of all of which are incorporated herein by reference.

FIELD

The present application relates to the field of air handling technologies, and particularly to a housing assembly for air handling apparatus and an air handling apparatus.

BACKGROUND

A housing component of a household window air conditioner includes a face plate and a frame, and usually, the face plate is fixed at the frame by snap joint or a screw, thereby forming a complete housing of the whole conditioner. In the assembly process, the face plate is required to be mounted at a preset position of the frame at a preset angle, and the angle needs to be readjusted in the case of a slight misalignment. The assembly has a certain requirement for the skill level and is time-consuming, with a low assembly efficiency.

SUMMARY

The present application seeks to solve at least one of the problems existing in a related art to some extent. Herein, an object of the present application is to provide a housing assembly of air handling apparatus, which may facilitate to increase an assembly efficiency.

Another object of the present application is to provide air handling apparatus.

A housing assembly for air handling apparatus according to an embodiment of the present application includes: a face frame provided with a main vent and a plurality of first snap joint members located at two opposite sides of the main vent; and a face plate provided at the face frame and provided with an air hole communicated with the main vent, the face plate being provided with a plurality of second snap joint members distributed at two opposite sides of the face plate and arranged centrosymmetrically, the plurality of second snap joint members being fitted with the plurality of first snap joint members in one-to-one correspondence.

In the housing assembly of air handling apparatus according to embodiments of the present application, since the plurality of second snap joint members at the two opposite sides of the face plate are provided centrosymmetrically, the face plate may also be mounted at the face frame after rotating by 180 degrees, which saves the time consumed on correction of a misoperation in assembly and increases the assembly efficiency effectively.

In some embodiments of the present application, the second snap joint member is configured as an elastic hook hooked on the first snap joint member, the elastic hook providing a certain elastic margin for assembly while enabling stable connection effectively.

In some embodiments of the present application, the face frame is provided with a plurality of first positioning members, the face plate is provided with a plurality of second positioning members located at the two opposite sides of the face plate and arranged centrosymmetrically, and the plurality of first and second positioning members are positioned and fitted in one-to-one correspondence respectively, so as to position and mount the face plate at the face frame. The first and second positioning members are fitted and positioned in advance, which may increase the assembly efficiency and reliability of an assembled structure and avoid a shift of the face plate relative to the frame.

In some embodiments of the present application, the first positioning member is configured as a fitting groove formed in the face frame, and the second positioning member extends into the fitting groove.

In some embodiments of the present application, a surface of the first positioning member coming into contact with the second positioning member serves as a first surface, a surface of the second positioning member coming into contact with the first positioning member serves as a second surface, and at least one of the first surface or the second surface is provided with a contact convex rib, which increases a contact area, thereby facilitating an increase in a stability of a mounted structure.

In some embodiments of the present application, the second snap joint members are provided at an upper side and a lower side of the face plate, and the second positioning members are provided at a left side and a right side of the face plate.

In some embodiments of the present application, the face frame is provided with a plurality of first limiting members centrosymmetrically distributed at two opposite sides of the face frame, and the face plate is provided with a plurality of second limiting members fitted with the plurality of first limiting members in one-to-one correspondence, so as to limit displacement of the face plate.

In some embodiments of the present application, the first limiting member is provided with a limiting protrusion, the second limiting member is configured as a limiting groove provided in the face plate, and the limiting protrusion extends into the limiting groove and abuts against an inner wall of the limiting groove.

In some embodiments of the present application, at least two of the first limiting members are provided with abutting protrusions facing the face frame directly, and a space for inserting a filter is defined between the face frame and the abutting protrusion.

In some embodiments of the present application, the face frame is provided with an auxiliary vent adjacent to the main vent, which may increase a ventilation quantity, thereby facilitating the air handling apparatus to handle and condition air.

Air handling apparatus according to another object of the present application includes the above-mentioned housing assembly. Thus, the air handling apparatus according to embodiments of the present application also has the advantage of the high assembly efficiency.

In some embodiments of the present application, the air handling apparatus is configured as a window air conditioner, a wall hole is provided in a wall and is provided with an annular wall sleeve therein, and the window air conditioner includes a main unit located in the wall sleeve; the face frame is provided at a front side of the main unit, and an outer peripheral wall of the face frame is located outside an outer peripheral wall of the main unit, so as to close over a front end surface of the wall sleeve.

In some embodiments of the present application, the main unit is covered by the face frame.

In some embodiments of the present application, the main unit includes: a chassis; and a front cover plate provided at a front portion of the chassis and located above the chassis to define, along with the chassis, an indoor mounting space having an open front side, the face frame being located at a front side of the front cover plate to close over an opening of the front side of the indoor mounting space, and the face frame being detachably mounted on the front cover plate.

In some embodiments of the present application, a first engaging member is provided at an inner peripheral wall of the face frame, and a second engaging member is provided at the front cover plate and is in snap fit with the first engaging member.

In some embodiments of the present application, the first engaging member is configured as an engaging rib provided on the inner peripheral wall of the face frame, and the second engaging member is configured as an engaging hole provided in the front cover plate.

In some embodiment of the present application, a rear surface of the engaging rib is formed as a guide surface, and in a direction from rear to front, the guide surface extends obliquely towards a direction close to a center line of the face frame extending in a front and rear direction.

In some embodiments of the present application, a part of the front cover plate protrudes in a direction close to or away from the center line of the face frame extending in the front and rear direction, so as to form a protuberance, and the second engaging member is provided on the protuberance.

In some embodiments of the present application, the front cover plate includes: a horizontal plate located right above the chassis and spaced apart therefrom; a first side plate extending vertically and having an upper end connected with a left end of the horizontal plate and a lower end connected with a left side wall of the chassis; and a second side plate provided opposite to the first side plate and having an upper end connected with a right end of the horizontal plate and a lower end connected with a right side wall of the chassis, wherein the indoor mounting space is defined by the second and first side plates, the horizontal plate and the chassis.

In some embodiments of the present application, the protuberance includes a first protuberance, a second protuberance and a third protuberance, a part of the horizontal plate protrudes upwards to form the first protuberance, a part of the first side plate protrudes leftwards to form the second protuberance, a part of the second side plate protrudes rightwards to form the third protuberance, and the second engaging member is provided on each of the first protuberance, the second protuberance and the third protuberance.

In some embodiments of the present application, the first protuberance is provided with a plurality of the second engaging members spaced apart from each other in a left and right direction.

In some embodiments of the present application, the front cover plate is an integrally formed part.

In some embodiments of the present application, the front cover plate is configured as a sheet metal part.

In some embodiments of the present application, the window air conditioner further includes an air duct member having an air flow channel formed and being located in the indoor mounting space.

In some embodiments of the present application, the air duct member is configured as a foam part and connected with an inner surface of the front cover plate.

Additional aspects and advantages of the present application will be given in part in the following descriptions, become apparent in part from the following descriptions, or be learned from the practice of the present application.

BRIEF DESCRIPTION OF THE DRAWINGS

The above and/or additional aspects and advantages of embodiments of the present application will become apparent and more readily appreciated from the following descriptions made with reference to the drawings, in which.

Figure 1:
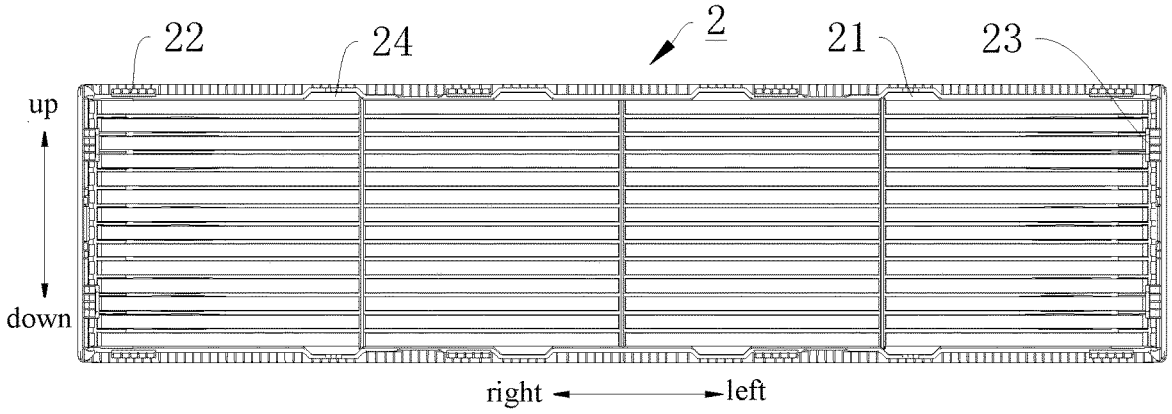
FIG. 1 is a rear view of a face plate of a housing assembly of air handling apparatus according to an embodiment of the present application.

REFERENCE NUMERALS window air conditioner 1000;

housing assembly 100;

face frame 1; main vent 11; first snap joint member 12; first positioning member 13; first limiting member 14; limiting protrusion 141; abutting protrusion 142; auxiliary vent 15; face frame body 16; flanging plate 17; first flange plate 171; second flange plate 172; third flange plate 173; fourth flange plate 174; first engaging member 18; engaging rib 181; guide surface 1811;

face plate 2; air hole 21; second snap joint member 22; second positioning member 23; second limiting member 24;

contact convex rib 3;

main unit 4; chassis 41; front cover plate 42; horizontal plate 420; first side plate 421; second side plate 422; second engaging member 423; engaging hole 4231; protuberance 424; first protuberance 4241; second protuberance 4242; third protuberance 4243; air duct member 43;

wall sleeve 2000.

DETAILED DESCRIPTION

Reference will be made in detail to embodiments of the present application, and the examples of the embodiments are illustrated in the drawings, wherein the same or similar elements and the elements having same or similar functions are denoted by like reference numerals throughout the descriptions. The embodiments described herein with reference to drawings are illustrative, and merely used to explain the present application. The embodiments shall not be construed to limit the present application.

In the description of the present application, it is to be understood that terms such as "center," "upper," "lower," "front," "rear," "left," "right," "inner" and "outer" should be construed to refer to the orientation as then described or as shown in the drawings under discussion. These relative terms are for convenience of description and do not require that the present application be constructed or operated in a particular orientation, thus cannot be construed to limit the present application. Furthermore, the feature associated with "first" and "second" may include one or more of this feature explicitly or implicitly. In the description of the present application, "a plurality of" means two or more unless otherwise stated.

In the description of the present application, it should be noted that unless specified or limited otherwise, the terms "mounted," "connected," and "coupled" and the like are used broadly, and may be, for example, fixed connections, detachable connections, or integral connections; may also be mechanical connections or electrical connections; may also be direct connections or indirect connections via intervening structures; may also be inner communications of two elements. The above terms can be understood by those skilled in the art according to specific situations.

In the description of the present application, the feature associated with "first" and "second" may include one or more of this feature. In addition, the terms such as "first" and "second" are used herein for purposes of description and are not intended to indicate or imply relative importance or significance or to imply the number of indicated technical features. Thus, the feature associated with "first" and "second" may include one or more of such feature explicitly or implicitly.

A housing assembly 100 of air handling apparatus according to an embodiment of the present application will be described in detail below with reference to FIGS. 1 to 14.

Figure 7:
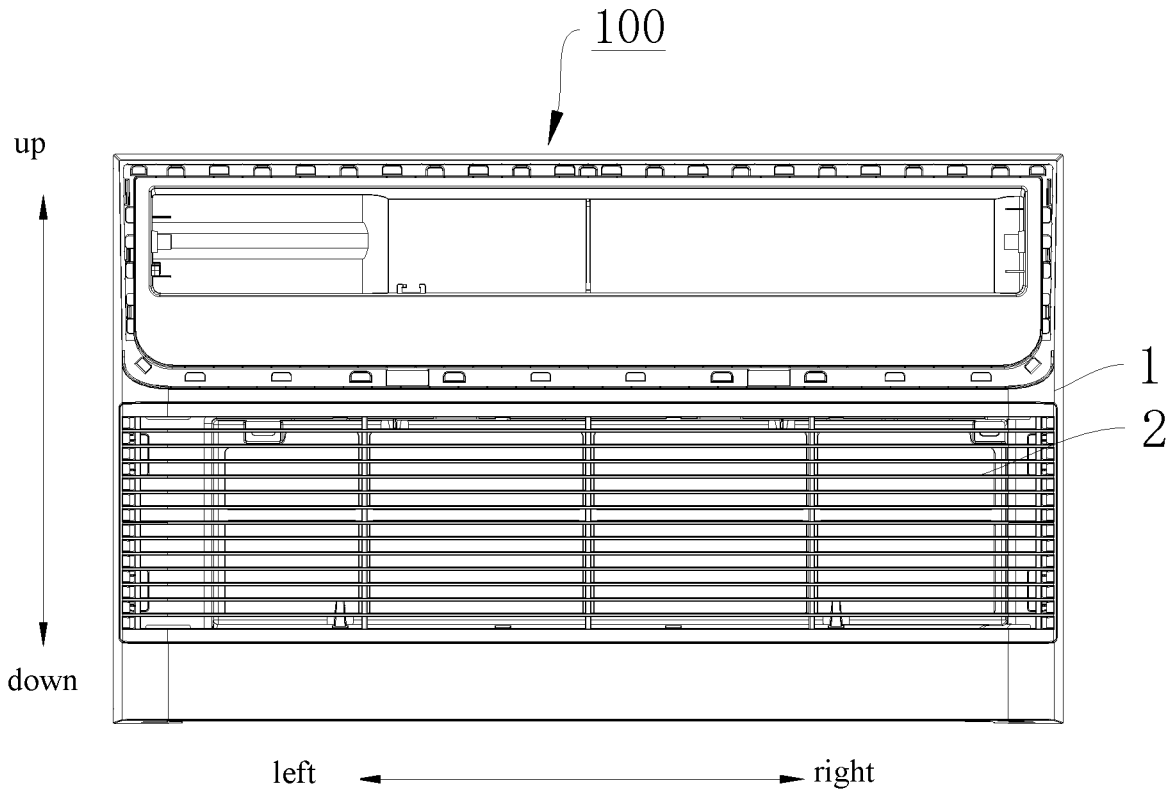
FIG. 7 is a front view of the housing assembly of air handling apparatus according to embodiments of the present application.
Figure 8:
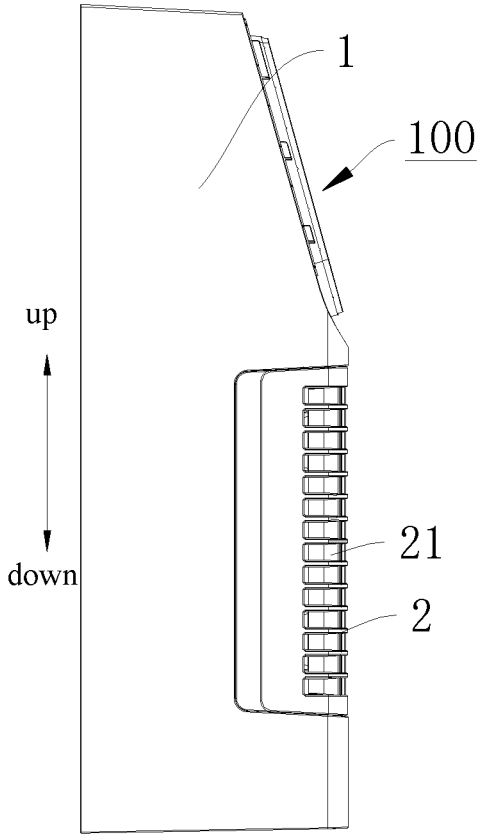
FIG. 8 is a side view of the housing assembly of air handling apparatus according to embodiments of the present application.
Figure 9:
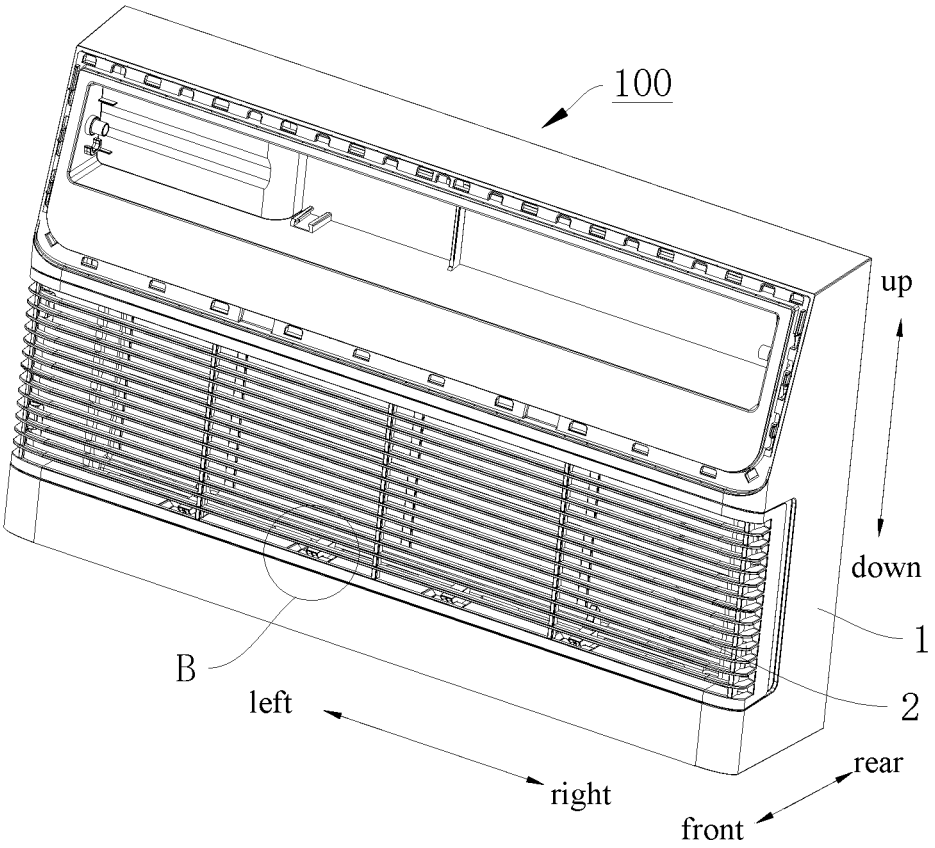
FIG. 9 is a perspective view of the housing assembly of air handling apparatus according to embodiments of the present application.

The housing assembly 100 of air handling apparatus according to embodiments of the present application may be applied to various air handling apparatus, such as an air conditioner, a window air conditioner, a purifier, a fresh air ventilator, or the like. Referring to FIGS. 7 to 9, the housing assembly 100 according to embodiments of the present application includes a face frame 1 and a face plate 2 mounted at and connected to the face frame 1 to form the complete housing assembly.

Referring to FIGS. 11 to 14, the face frame 1 is provided with a main vent 11 and a plurality of first snap joint members 12 located at two opposite sides of the main vent 11. Referring to FIGS. 1 to 6, the face plate 2 is provided at the face frame 1 and provided with an air hole 21 communicating with the main vent 11, the face plate 2 is provided with a plurality of second snap joint members 22 distributed at two opposite sides of the face plate 2 centrosymmetrically, and the plurality of second snap joint members 22 are configured to be fitted with the plurality of first snap joint members 12 in one-to-one correspondence. The face plate 2 is engaged with the face frame 1 by the plurality of first and second snap joint members 12, 22, with convenient assembly and a stable structure.

In the housing assembly 100 of air handling apparatus according to embodiments of the present application, since the plurality of second snap joint members 22 at the two opposite sides of the face plate 2 are provided centrosymmetrically, the face plate 2 may also be mounted at the face frame 1 after rotating by 180 degrees, which saves a time consumed on the correction of a misoperation in assembly and increases an assembly efficiency effectively.

In the above-mentioned embodiment, the plurality of second snap joint members 22 are provided at the two opposite sides of the face plate 2, and specifically, in conjunction with an example and an orientation shown in FIG. 1, the second snap joint members 22 may be provided at an upper side and a lower side of the face plate 2. The number of second snap joint members 22 provided at the upper and lower sides of the face plate 2 may be determined according to an actual condition. In the example of FIG. 1, four second snap joint members 22 are provided at the upper side of the face plate 2, four second snap joint members 22 are provided at the lower side of the face plate 2, and the eight second snap joint members 22 are symmetric with respect to a center of the face plate 2, so as to ensure that the face plate 2 may be mounted at the face frame 1 at a preset angle and after rotating by 180 degrees from the preset angle, which facilitates an increase in the production and assembly efficiencies.

In the embodiment shown in FIG. 1, the second snap joint members 22 have an identical structure, thereby ensuring that the face plate 2 may be fitted and connected with the first snap joint member 12 at the face frame 1 after rotating by 180 degrees. Certainly, the technical idea of the present application is not limited to providing the plurality of second snap joint members 22 at the upper and lower sides of the face plate 2, and the second snap joint members 22 may also be provided at a left side and a right side for mounting and positioning purposes. In some embodiments, the face plate 2 may be polygonal, and the second snap joint members 22 may be provided at the two opposite sides of the face plate 2, as long as the second snap joint members 22 are provided symmetrically with respect to the center of the face plate 2.

Since the first snap joint member 12 at the face frame 1 needs to be fitted with the second snap joint member 22, the first snap joint members 12 are provided at the face frame 1 centrosymmetrically with respect to a point corresponding to the center of the face plate 2. The first snap joint member may be engaged with the second snap joint member in a plurality of ways. For example, the second snap joint member 22 is configured as an elastic hook hooked at the first snap joint member 12. Or, referring to FIG. 14, the first snap joint member 12 is configured as an elastic hook hooked at the second snap joint member 22. The elastic hook may provide a certain elastic margin when snapped into the snap joint member in assembly, thereby realizing the snap joint connection and realizing the stability of the snap joint connection structure.

Figure 2:
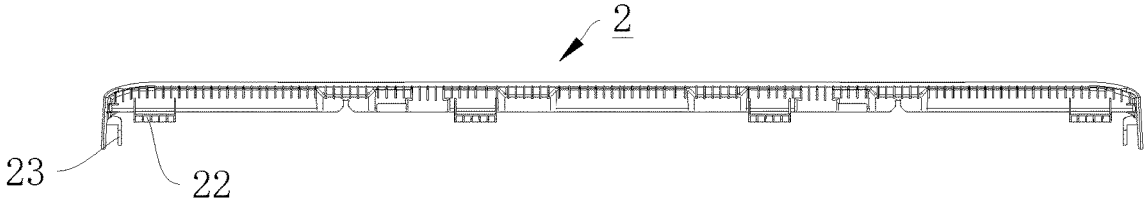
FIG. 2 is a bottom view of the face plate of the housing assembly of air handling apparatus according to embodiments of the present application.
Figure 3:
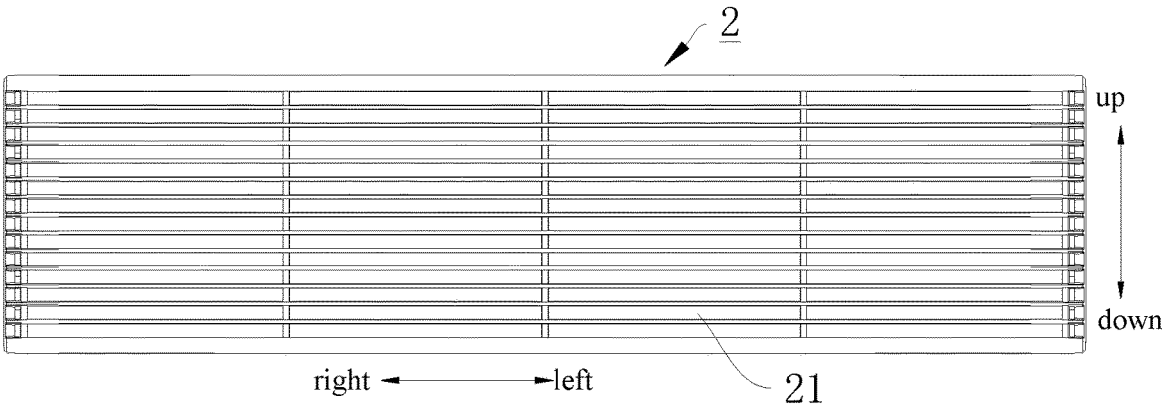
FIG. 3 is a front view of the face plate of the housing assembly of air handling apparatus according to embodiments of the present application.
Figure 4:
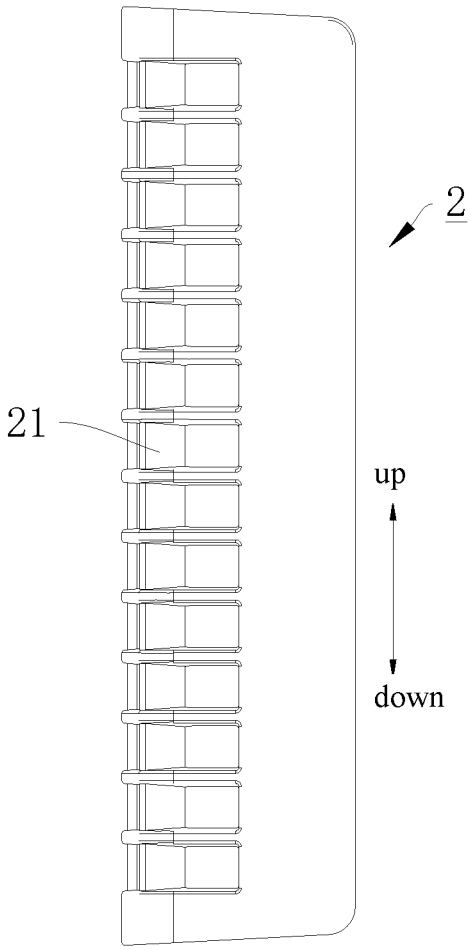
FIG. 4 is a side view of the face plate of the housing assembly of air handling apparatus according to embodiments of the present application.
Figure 5:
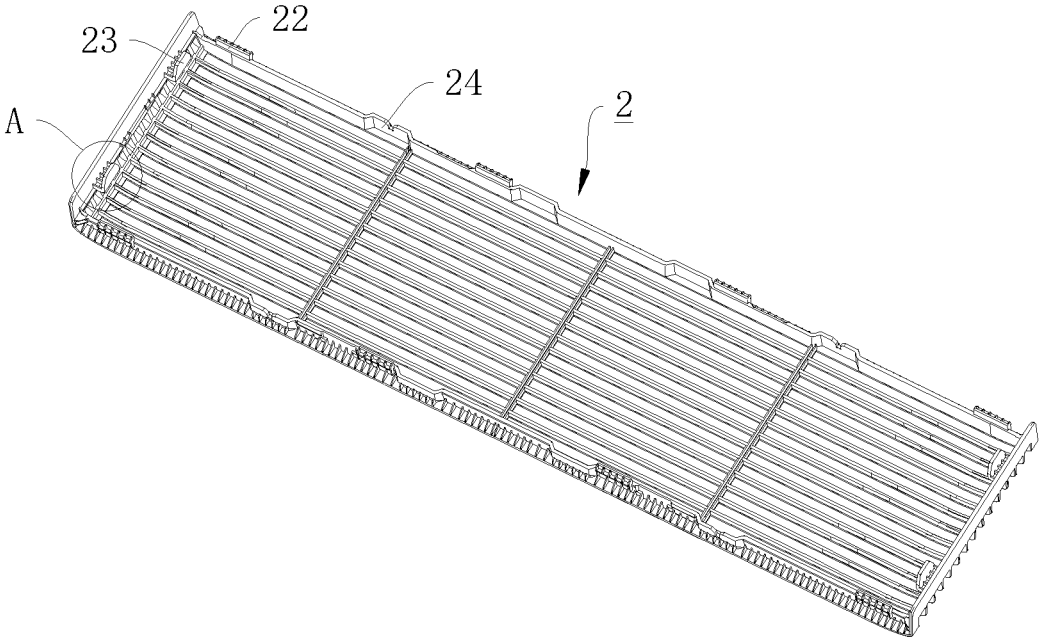
FIG. 5 is a perspective view of the face plate of the housing assembly of air handling apparatus according to embodiments of the present application.

Referring to FIGS. 1, 2 and 5, a barb or a contact rib may also be provided at a contact surface of the second snap joint member 22 engaged with the first snap joint member 12, thereby connecting the second snap joint member 22 with the first snap joint member 12 more tightly and stably.

Figure 6:
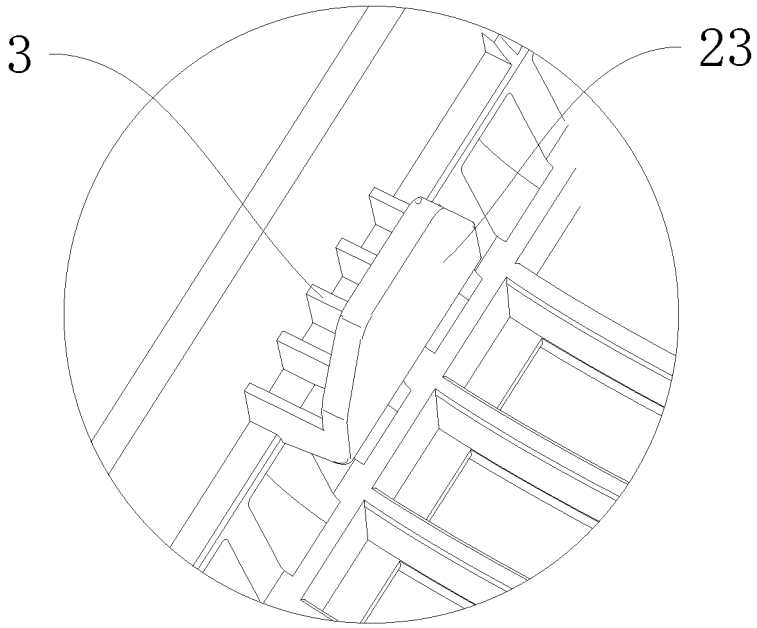
FIG. 6 is an enlarged view of a circled portion A in FIG. 5.
Figure 11:
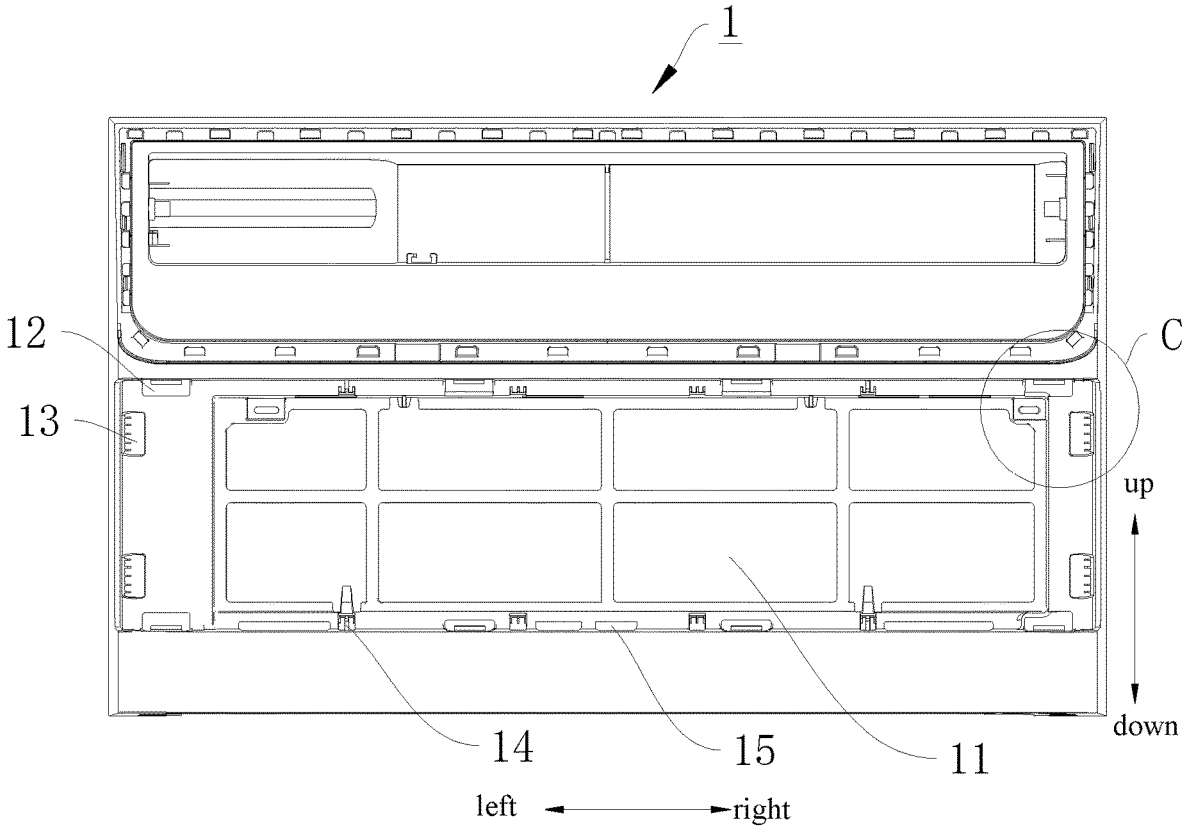
FIG. 11 is a front view of a face frame of the housing assembly of air handling apparatus according to embodiments of the present application.
Figure 14:
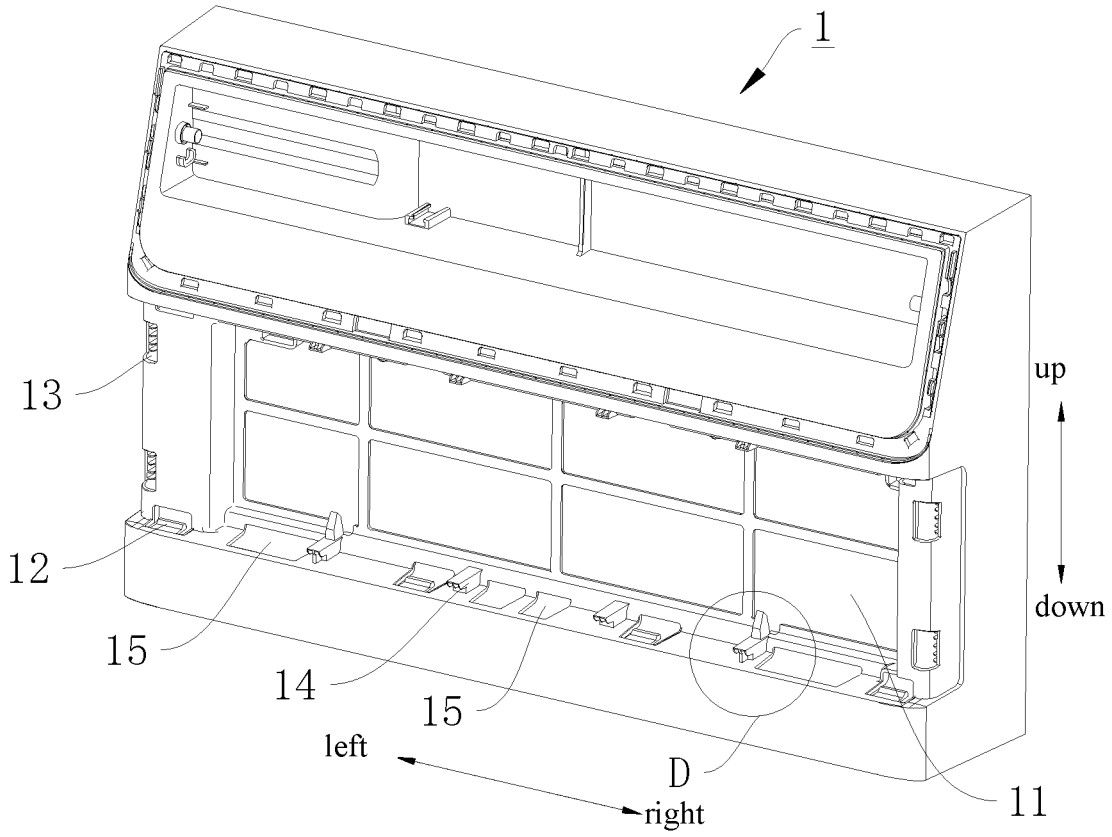
FIG. 14 is a perspective view of the face frame of the housing assembly of air handling apparatus according to embodiments of the present application.

In order to further increase the assembly efficiency, a reference is provided for a connection position of the face plate 2 and the face frame 1 in assembly, and referring to FIGS. 11 and 14, the face frame 1 is provided with a plurality of first positioning members 13. Referring to FIGS. 5 and 6, the face plate 2 is provided with a plurality of second positioning members 23 located at the two opposite sides of the face plate 2 centrosymmetrically, and the plurality of first and second positioning members 13, 23 are positioned and fitted in one-to-one correspondence respectively, so as to position and mount the face plate 2 at the face frame 1.

Referring to FIGS. 11 and 14, the plurality of first positioning members 13 at the face frame 1 are provided at a left side and a right side of the face frame 1. More precisely, two first positioning members 13 are provided at the left side of the face frame 1, two first positioning members 13 are provided at the right side of the face frame 1, the four first positioning members 13 are distributed symmetrically with respect to a center of the main vent, and it may be understood that usually, the center of the main vent corresponds to a central point of the face plate 2.

Referring to FIGS. 5 and 6, the plurality of second positioning members 23 at the face plate 2 are provided at left and right sides of the face plate 2. Two second positioning members 23 are provided at the left side of the face plate 2, two second positioning members 23 are provided at the right side of the face plate 2, and the four second positioning members 23 are distributed symmetrically with respect to the center of the face plate 2.

Certainly, positions and numbers of the first positioning member 13 at the face frame 1 and the second positioning member 23 at the face plate 2 are not limited to the above-mentioned two embodiments, but distribution and structures of the first and second positioning members are required to be distributed symmetrically with respect to the central point of the face plate 2 respectively. The first and second positioning members 13, 23 may be attached or abutted and easy to separate, and the reference may be provided for connection between the face plate 2 and the face frame 1 by positioning and fitting the first and second positioning members 13, 23, thereby having a pre-positioning effect and further increasing the assembly efficiency.

A way of attaching and positioning the first and second positioning members 13, 23 will be introduced below. Referring to FIG. 14, the first positioning member 13 is configured as a fitting groove formed at the face frame 1, and the second positioning member 23 extends into the fitting groove. For example, referring to FIG. 6, the second positioning member 23 may be configured as a flange extending towards the fitting groove, and the flange extends into the groove and is attached to a side wall thereof. Specifically, referring to FIG. 14, the first positioning members 13 are configured as two fitting grooves spaced apart from each other at the left and right sides of the face frame 1. Referring to FIG. 5, the second positioning members 23 are configured as flanges spaced apart from each other at the left and right sides of the face plate 2, and correspondingly, the flange extends into the fitting groove to position the face plate 2 and the face frame 1 left and right. After assembly, the face plate 2 and the face frame 1 may be avoided being misaligned in the left and right direction, thereby connecting the face plate 2 and the face frame 1 stably.

Figure 12:
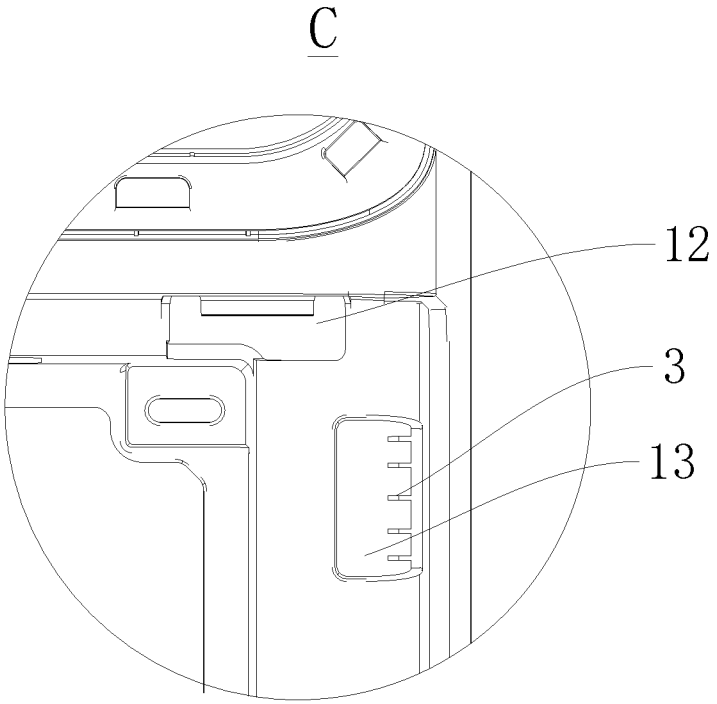
FIG. 12 is an enlarged view of a circled portion C in FIG. 11.
Figure 13:
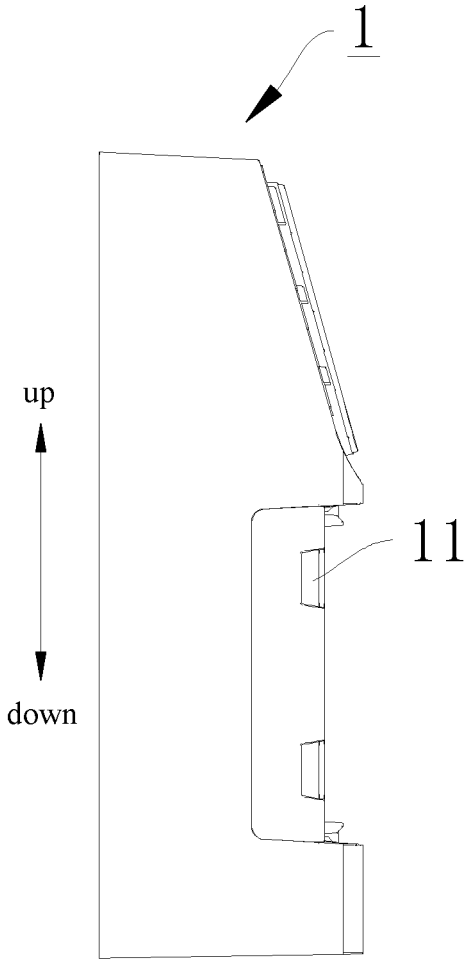
FIG. 13 is a side view of the face frame of the housing assembly of air handling apparatus according to embodiments of the present application.

In the above-mentioned embodiment, a surface of the first positioning member 13 coming into contact with the second positioning member 23 serves as a first surface, a surface of the second positioning member 23 coming into contact with the first positioning member 13 serves as a second surface, and referring to FIGS. 6 and 12, the first and second surfaces are each provided with a contact convex rib 3. The contact convex ribs 3 may be configured as a plurality of ribs spaced apart from each other, the contact convex ribs 3 at the first and second surfaces are in insertion fit, thus dual surface contact between the first and second surfaces is changed into multisurface contact between the contact convex ribs 3, thereby further increasing tightness of a connecting structure.

Or, the contact convex rib 3 may be provided only at the first surface. In some embodiments, the contact convex rib 3 may also be provided only at the second surface.

In the housing assembly 100 of air handling apparatus according to the above-mentioned embodiment, the face plate 2 is provided with the second snap joint member 22 and the second positioning member 23, so as to connect fixedly and position the face plate 2 at the face frame 1. In one embodiment, the second snap joint members 22 are provided at the upper and lower sides of the face plate 2, and the second positioning members 23 are provided at the left and right sides of the face plate 2, thereby positioning left and right and mounting up and down the face plate 2 at the face frame 1.

Figure 10:
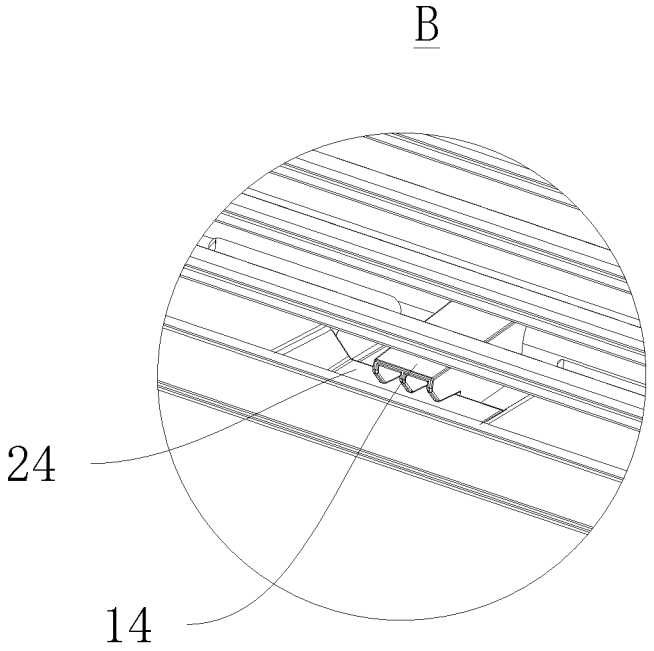
FIG. 10 is an enlarged view of a circled portion B in FIG. 9.

Referring to FIGS. 9 and 10, in order to avoid displacement and looseness of the face plate 2 in a front and rear direction, the face frame 1 is provided with a plurality of first limiting members 14 distributed at the two opposite sides of the face frame 1 centrosymmetrically. The face plate 2 is provided with a plurality of second limiting members 24 fitted with the plurality of first limiting members 14 in one-to-one correspondence, so as to limit the displacement of the face plate 2.

Referring to FIG. 1 or 5, four second limiting members 24 are provided at each of the upper and lower sides of the face plate 2. Correspondingly, referring to FIG. 14, four first limiting members 14 are provided at each of the upper and lower sides of the face frame 1. The second limiting members 24 are distributed at the face plate 2 centrosymmetrically, the first limiting members 14 are distributed at the face frame 1 centrosymmetrically, and the eight second limiting members 24 are fitted with, for example, abut against or engaged with the eight first limiting members 14 correspondingly for limiting movement of the face plate 2 at the face frame 1. In some other embodiments, the first limiting members 14 may be provided at the left and right sides of the face frame 1, and the second limiting members 24 may be provided at the left and right sides of the face plate 2, or the like, which will not be enumerated herein.

In one embodiment, the first limiting member 14 abuts against the second limiting member 24. Referring to FIG. 10, the first limiting member 14 is provided with a limiting protrusion 141, the second limiting member 24 is configured as a limiting groove provided at the face plate 2, and the limiting protrusion 141 extends into the limiting groove and abuts against an inner wall of the limiting groove.

A housing assembly of some air handling apparatus, such as an air conditioner, or the like, further includes a filter. The filter may be configured as a filter screen, a HEPA (High Efficiency Particulate Air) screen, or the like. A limiting structure is required to be provided at the face frame 1 to limit the filter. In the housing assembly 100 of air handling apparatus according to embodiments of the present application, at least two first limiting members 14 are provided with abutting protrusions 142 facing the face frame 1 directly, and an insertion space for the filter is formed between the face frame 1 and the abutting protrusion 142.

Figure 15:
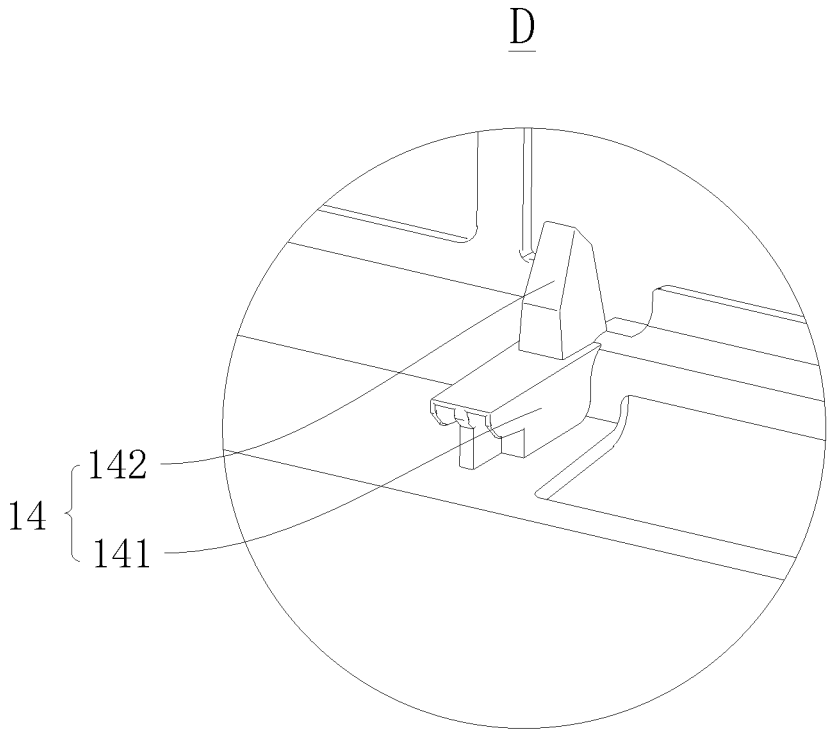
FIG. 15 is an enlarged view of a circled portion Din FIG. 14.

Referring to FIGS. 14 and 15, four first limiting members 14 are provided at each of the upper and lower sides of the face frame 1. Two types of first limiting members 14 are provided, one type being only provided with a limiting protrusion 141, and the other type including a limiting protrusion 141 and abutting protrusions 142 located at a left side and a right side of the limiting protrusion, and the limiting protrusion is perpendicular to the abutting protrusion. The abutting protrusion 142 is provided parallel to the main vent of the face frame 1, and the filter may be inserted between the abutting protrusion 142 and the face frame 1, thereby filtering air entering or exiting the main vent.

Referring to FIG. 14, the face frame 1 is provided with an auxiliary vent 15 close to the main vent 11. The arrangement of the auxiliary vent 15 may increase a ventilation quantity, thereby facilitating an improvement to an air handling capacity of the air handling apparatus, such as temperature adjustment, dust purification, humidity increase, or the like. Specifically, in the embodiment shown in FIG. 14, four auxiliary vents 15 in two sizes are provided at a lower side of the main vent 11 of the face frame 1, the auxiliary vents 15 close to two sides of the first positioning member 13 have a larger size, and the auxiliary vents 15 provided in a middle portion have a smaller size. An extension direction of the auxiliary vent 15 is perpendicular to that of the main vent 11, and more precisely, the auxiliary vent 15 may increase the ventilation quantity of the air handling apparatus in the up and down direction. Certainly, the auxiliary vents 15 may also be provided at the left and right sides of the main vent, or the like, which will not be enumerated herein.

In addition, the present application further provides air handling apparatus according to an embodiment of the present application, including the above-mentioned housing assembly 100. Similarly, since the air handling apparatus according to embodiments of the present application has the housing assembly 100 provided with a fool-proof structure, the assembly efficiency is increased effectively.

In conclusion, the housing assembly 100 of air handling apparatus and the air handling apparatus according to the embodiments of the present application facilitate the increase in the assembly efficiency, have stable structures and large ventilation quantities, and facilitate popularization.

The air handling apparatus according to embodiments of the present application will be described below with reference to the accompanying drawings, and in the following description, the air handling apparatus will be explained by taking a window air conditioner 1000 as an example.

Figure 16:
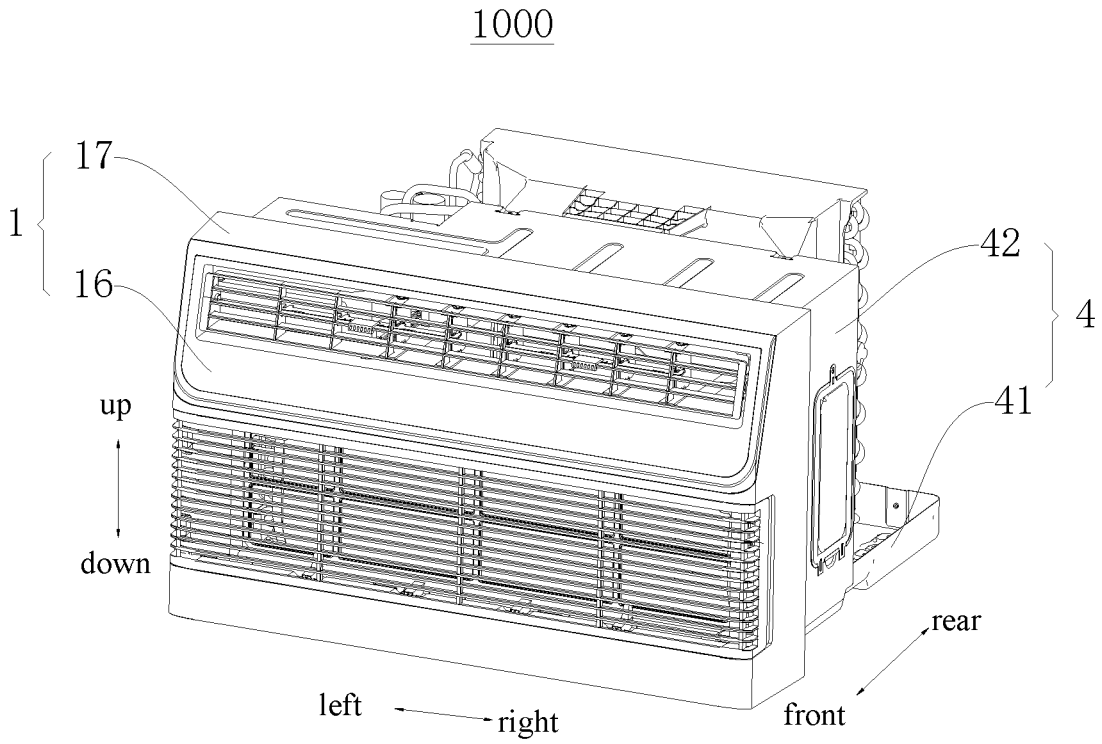
FIG. 16 is a perspective view of air handling apparatus according to an embodiment of the present application from a front angle of view.
Figure 17:
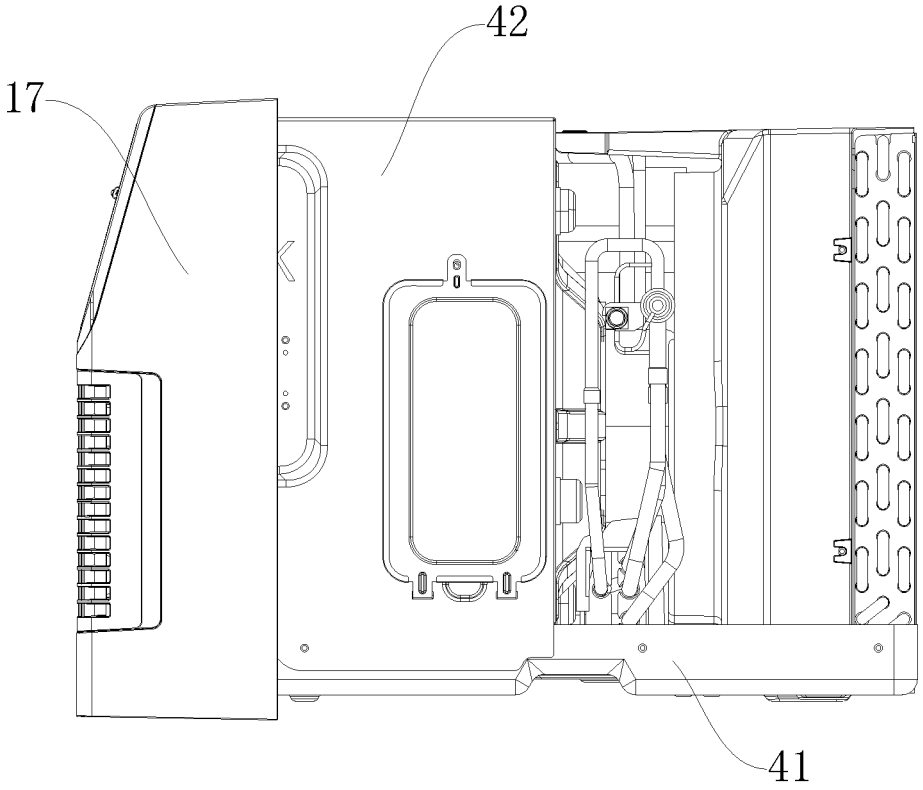
FIG. 17 is a right view of the air handling apparatus according to embodiments of the present application.
Figure 24:
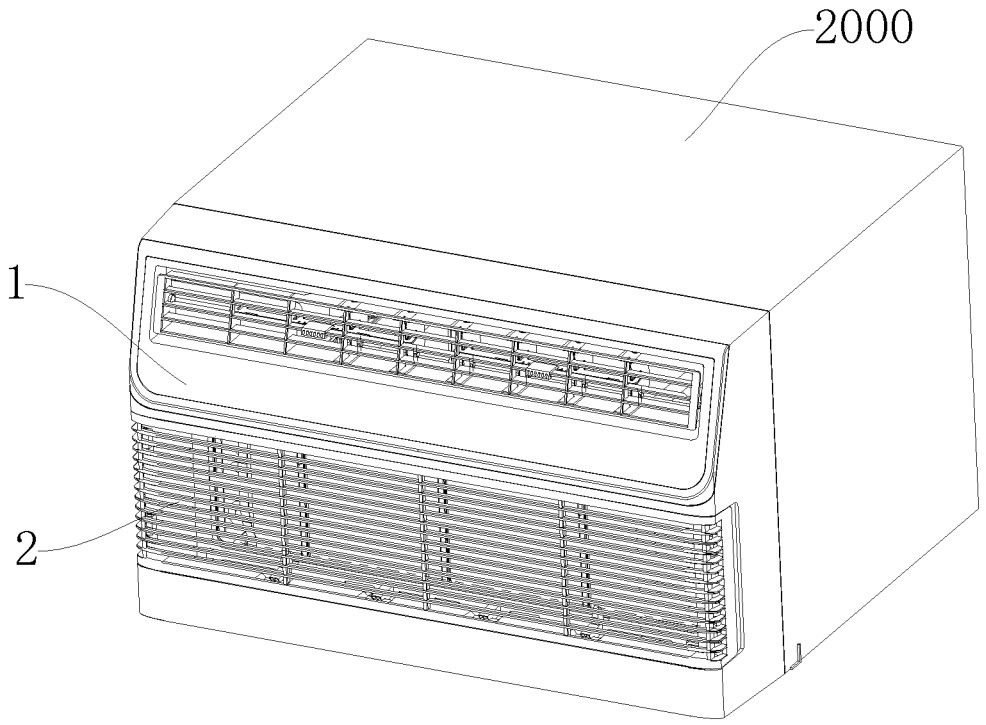
FIG. 24 is a perspective view in which the air handling apparatus according to embodiments of the present application is mounted in a wall sleeve.

In some embodiments of the present application, as shown in FIGS. 16, 17 and 24, the window air conditioner 100 includes a main unit 4, a wall hole is provided at a wall and provided therein with a wall sleeve 2000 having, e.g., a closed shape, the main unit 4 is suitable for being located in the wall sleeve 2000, the face frame 1 is provided at a front side of the main unit 4, and an outer peripheral wall of the face frame 1 is located at an outer side of an outer peripheral wall of the main unit 4, so as to be suitable for closing over a front end surface of the wall sleeve 200. That is, in a plane perpendicular to the front and rear direction, a projection of the main unit 4 is located in that of the face frame. Thus, when the main unit 4 is mounted in the wall sleeve 2000, a portion of the face frame 1 protruding out of the main unit 4 may close over the front end surface of the wall sleeve 2000, such that the face frame 1 may shield a gap between the main unit 4 and the wall sleeve 2000, thereby improving a visual effect after the window air conditioner 1000 is mounted. In the description of the present application, when a user faces the face frame 1 directly, a direction pointing to the user is considered as front direction, and a direction pointing away from the user is considered as rear direction.

Figure 19:
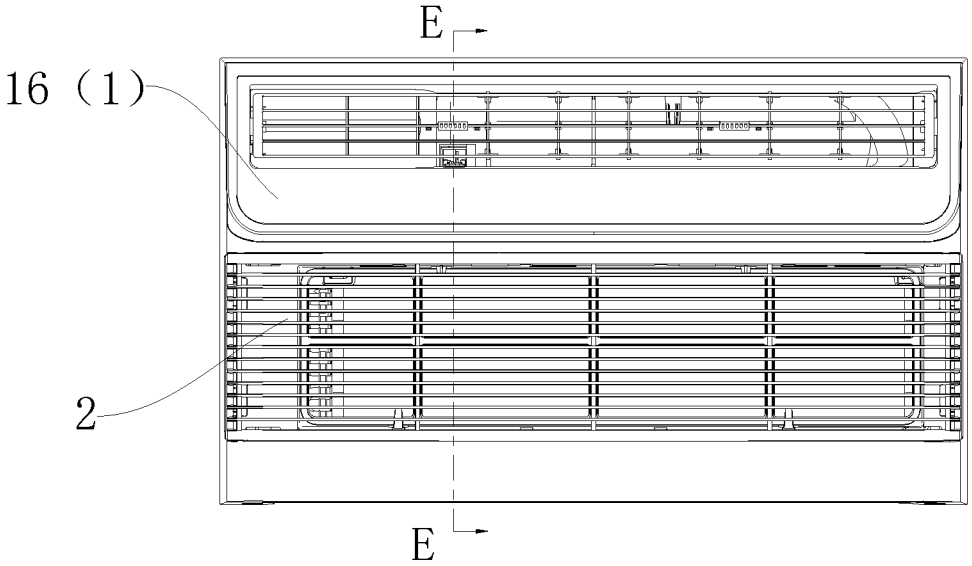
FIG. 19 is a front view of the air handling apparatus according to embodiments of the present application.

In a specific application, referring to FIG. 24, usually, the wall sleeve 2000 has a square ring structure as well as an open front end and an open rear end. For example, referring to FIGS. 17 and 19, the main unit 4 and the face frame 1 of the window air conditioner 1000 are both substantially square, the face frame 1 is located at a front side of the main unit 4, and sizes of the face frame 1 in a left and right direction and the up and down direction are greater than sizes of the main unit 4 in the left and right direction and the up and down direction, thereby protruding the outer peripheral wall of the face frame 1 out of an outer peripheral wall of the main unit 4. When the window air conditioner 1000 is mounted in the wall sleeve 2000, the main unit 4 is located in the wall sleeve 2000, the face frame 1 is located at a front side of the wall sleeve 2000, and a portion of the face frame 1 protruding out of the main unit 4 may be fitted with the wall sleeve 2000 to close over the front end surface of the wall sleeve 2000, such that the user may not see the gap between the main unit 4 and the wall sleeve 200, which guarantees an overall appearance effect of the window air conditioner.

In related art, there are many types of window air conditioners 1000. Besides the standard window air conditioner 1000 which may be mounted at a window, there also exists a relatively common wall penetrating machine mounted at the wall, a wall hole is provided at the wall, a wall sleeve 2000 is mounted in the wall hole, and the wall penetrating machine is mounted in the wall sleeve 2000. The wall hole is pre-formed in a building process of a building, and in order to unify standards, generally, the wall hole and the wall sleeve 2000 have four sizes of 24 inches, 25 inches, 26 inches and 27 inches. In order to be adapted to the wall sleeves 2000 having different sizes, usually, a size of the wall penetrating machine will be set to be 24 inches by an air conditioner manufacturer, such that the wall penetrating machine may be mounted at the wall sleeves 2000 having different sizes. With this setting, when the wall penetrating machine is mounted in a relatively large wall sleeve 2000, an obvious gap may exist between the wall penetrating machine and the wall sleeve 2000, which may not only affect an appearance effect of the wall penetrating machine, but also cause air leakage when the wall penetrating machine is in use, thereby affecting a user experience seriously.

In view of this, the structure of the window air conditioner 1000 is improved herein in that the outer peripheral wall of the face frame 1 of the window air conditioner 1000 is located at the outer side of the outer peripheral wall of the main unit 4, and thus when the main unit 4 is mounted in the wall sleeve 2000, the portion of the face frame 1 protruding out of the main unit 4 may be fitted with the wall sleeve 2000 to close over the front end surface of the wall sleeve 2000, such that the user may not see the gap between the main unit 4 and the wall sleeve 2000, which, compared with a structural form in which the outer peripheral wall of the face frame 1 is flush with the outer peripheral wall of the main unit 4 in the related art, may improve remarkably the visual effect after the window air conditioner 1000 is mounted, facilitate reduction of air leakage of the window air conditioner 1000 due to the gap, and improve the user experience.

Figure 18:
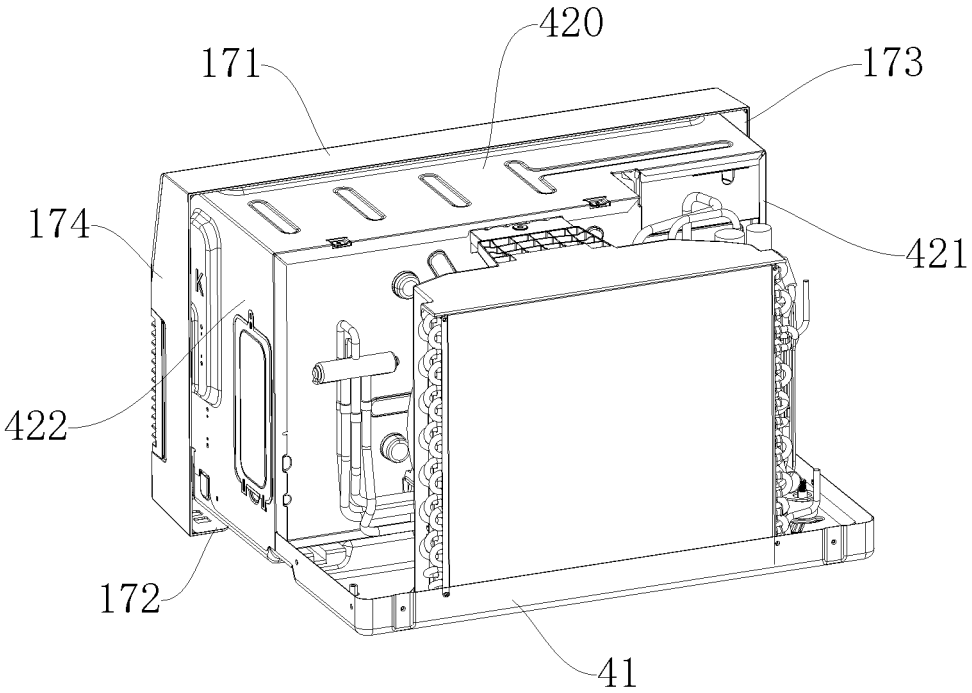
FIG. 18 is a perspective view of the air handling apparatus according to embodiments of the present application from a rear angle of view.

The outer peripheral wall of the face frame 1 of the window air conditioner 1000 according to embodiments of the present application is located at the outer side of the outer peripheral wall of the main unit 4, and thus when the main unit 4 is mounted in the wall sleeve 2000, the portion of the face frame 1 protruding out of the main unit 4 may be fitted with the wall sleeve 2000 to close over the front end surface of the wall sleeve 2000, such that the user may not see the gap between the main unit 4 and the wall sleeve 2000, which may improve remarkably the visual effect after the window air conditioner 1000 is mounted, facilitate reduction of air leakage of the window air conditioner 1000 due to the gap, and improve the user experience.

in some embodiments of the present application, as shown in FIGS. 17 and 18, the main unit 4 is covered by the face frame 1, thus having a simple structure and facilitating implementation.

Specifically, for example, referring to FIGS. 16 and 17, the face frame 1 includes a face frame body 16 and a flanging plate 17, the flanging plate 17 extends backwards, has a shape of closed loop and is provided at an outer peripheral wall of the face frame body 16 in a circumferential direction of the face frame body 16. Thus, a placing space may be enclosed between the flanging plate 17 and the face frame body 16, and when the face frame 1 is mounted at the main unit 4, a front end of the main unit 4 is located in the placing space, thereby having a simple structure and facilitating a mounting process; further, the arrangement of the flanging plate 17 may further protect the main unit 4 to some extent. In a practical application, the face frame 1 is an integral part that is injection molded, and thus is convenient to process and suitable for volume production.

Optionally, as shown in FIG. 18, the flanging plate 17 has a square ring structure and includes a first flange plate 171 at an upper side, a second flange plate 172 at a lower side, a third flange plate 173 at a left side and a fourth flange plate 174 at a right side, wherein the first and second flange plates 171, 172 extend horizontally and are spaced apart and opposite to each other, the third and fourth flange plates 173, 174 extend vertically and are spaced apart and opposite to each other, two ends of the third flange plate 173 are connected with left ends of the first and second flange plates 171, 172 respectively, and two ends of the fourth flange plate 174 are connected with right ends of the first and second flange plates 171, 172 respectively, thereby having a simple structure and facilitating a processing action.

In some embodiments of the present application, as shown in FIGS. 16 and 17, the main unit 4 includes: a chassis 41; and a front cover plate 42 provided at a front portion of the chassis 41 and located above the chassis 41 to form an indoor mounting space having an open front side with the chassis 41, and the face frame 1 is located at a front side of the front cover plate 42 to close over an open position of the front side of the indoor mounting space, and mounted at the front cover plate 42 detachably, thus facilitating disassembly and assembly of the face frame 1 and the front cover plate 42.

Figure 22:
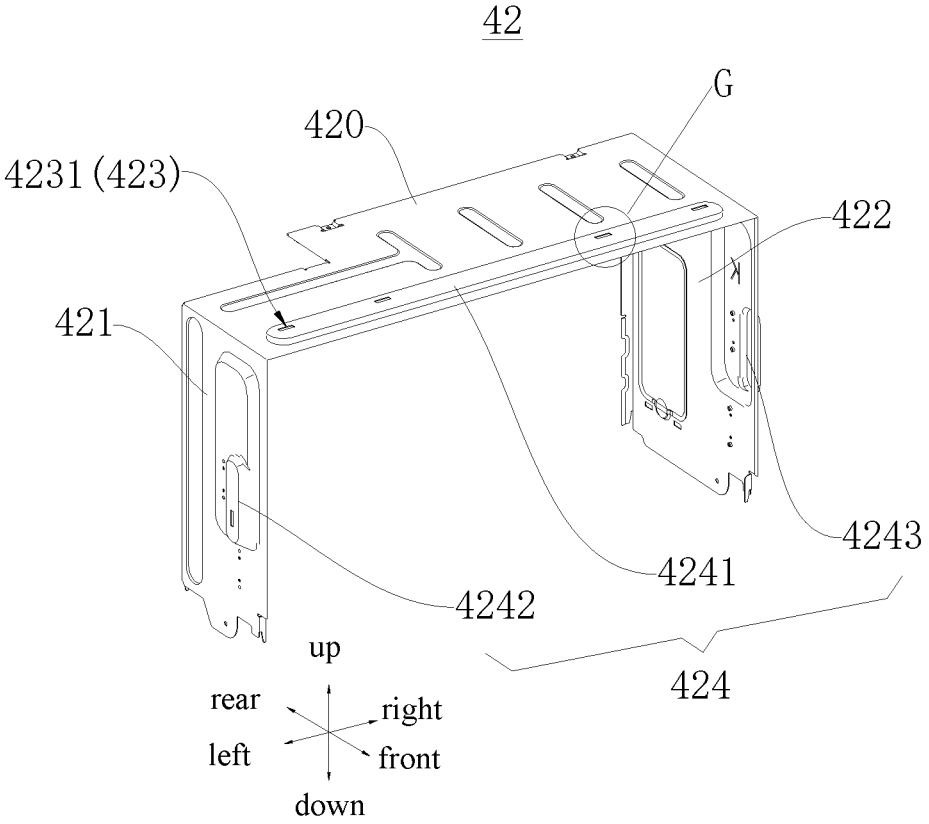
FIG. 22 is a perspective view of a front cover plate according to an embodiment of the present application.

Specifically, for example, referring to FIGS. 18 and 22, the front cover plate 42 includes a horizontal plate 420, a first side plate 421 and a second side plate 422. The horizontal plate 420 is located right above and spaced apart from the chassis 41, the first and second side plates 421, 422 extend vertically, and the first side plate 421 has an upper end connected with a left end of the horizontal plate 420 and a lower end connected with a left side wall of the chassis 41. The second side plate 422 is provided opposite to the first side plate 421 and has an upper end connected with a right end of the horizontal plate 420 and a lower end connected with a right side wall of the chassis 41. Thus, the indoor mounting space having the open front side is formed by the second and first side plates 422, 421, the horizontal plate 420 and the chassis 41, and components, such as an indoor heat exchanger, a draught fan, or the like, may be mounted in the indoor mounting space. When the face frame 1 is mounted at the front cover plate 42, the first flange plate 171 is located at an upper side of the horizontal plate 420, the second flange plate 172 is located below the chassis 41, the third flange plate 173 is located at a left side of the first side plate 421, and the fourth flange plate 174 is located at a right side of the second side plate 422.

Usually, an overall structure of the wall penetrating machine in the related art is provided with an outer box, the face frame 1 of the wall penetrating machine is mounted at the outer box directly, and since the outer box is usually a sheet metal part, has a relatively large size and is prone to deform in an assembly process of the wall penetrating machine, a poor appearance, such as a step, a gap, or the like, is caused after the outer box and the face frame 1 are assembled. Furthermore, when a part of the wall penetrating machine is mounted in the wall sleeve 2000, the wall sleeve 2000 is equivalent to the outer box for the whole wall penetrating machine, but the outer box only has a function of fixing the face frame 1, and thus the outer box and the wall sleeve 2000 have a problem of duplication of functionality to some extent.

In view of this, the structure of the window air conditioner 1000 is further improved in that a traditional way of mounting the face frame 1 is changed, the face frame 1 is no longer connected with the outer box, but with the front cover plate 42, and thus when the window air conditioner 1000 is produced, the original outer box may be omitted, thereby facilitating an increase in a production efficiency of the whole conditioner and meanwhile reducing a production cost of the whole conditioner; furthermore, the face frame 1 is connected with the front cover plate 42 detachably, with convenient assembly.

In the window air conditioner 1000 according to embodiments of the present application, the face frame 1 is connected with the front cover plate 42. Thus, compared with a structural form of the window air conditioner 1000 in which the face frame 1 is connected with the outer box in the related art, when the widow type air conditioner is produced, the original outer box may be omitted, thereby facilitating the increase in the production efficiency of the whole conditioner while reducing the production cost of the whole conditioner; furthermore, the face frame 1 is connected with the front cover plate 42 detachably, with convenient assembly.

Figure 20:
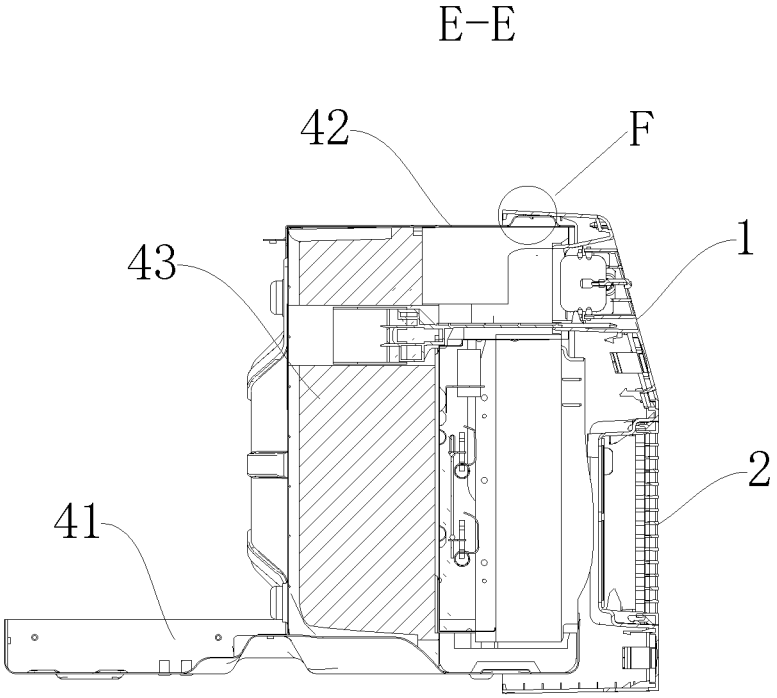
FIG. 20 is a cross-sectional view along line E-E in FIG. 19.
Figure 21:
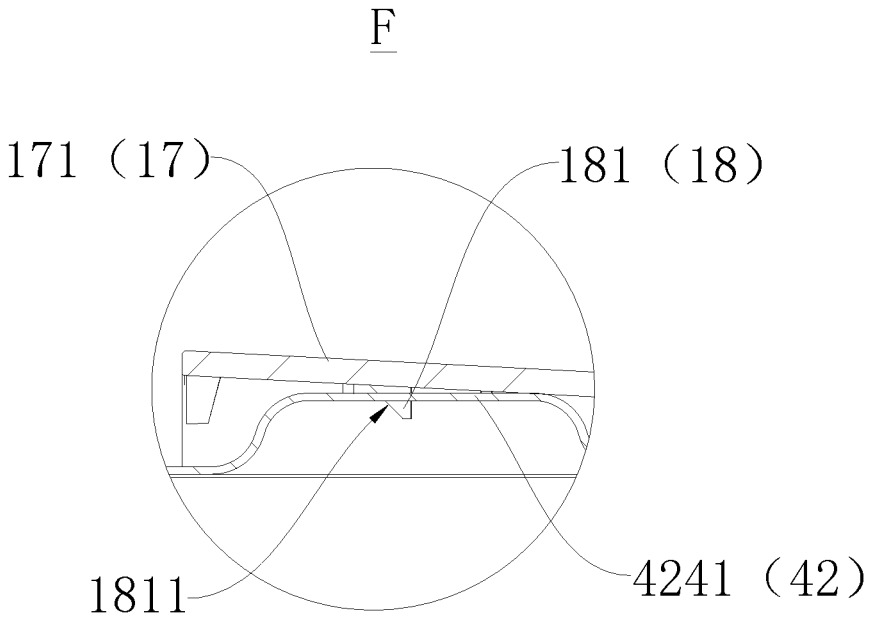
FIG. 21 is an enlarged view of a circled portion F in FIG. 20.

In some embodiments of the present application, as shown in FIGS. 20, 21 and 22, a first engaging member 18 is provided at the inner peripheral wall of the face frame 1, a second engaging member 423 is provided at the front cover plate 42 and in snap fit with the first engaging member 18, and thus the face frame 1 may be connected with the front cover plate 42 detachably; furthermore, generally, the clamped connection only requires one insertion action, with convenient assembly.

Optionally, for the face frame 1, the first engaging member 18 may be provided at an inner surface of the flanging plate 17. In the specific application, the first engaging member 18 is provided at at least one of the first, second or third flange plate 171, 172, 173. For example, in one embodiment, the first, second and third flange plates 171, 172, 173 are each provided with the first engaging member 18.

Optionally, for the front cover plate 42, the second engaging member 423 is provided at at least one of the horizontal plate 420, the first side plate 421, or the second side plate 422. For example, referring to FIG. 22, in one embodiment, the horizontal plat 420 as well as the first and second side plates 421, 422 are each provided with the second engaging member 423.

It is understood that the face frame 1 and the front cover plate 42 may be connected detachably in other ways, besides the way of connecting the first and second engaging members 18, 423.

For example, in some embodiments, the face frame 1 is connected with the front cover plate 423 by a fastener. Specifically, a through hole is provided at the face frame 1, a stud is provided at the front cover plate 42 and provided therein with a threaded hole, and the fastener may be configured as a screw. During practical assembly, when the through hole corresponds to the threaded hole, a screw may penetrate through the through hole to be in threaded connection with the threaded hole, and such a connection is simple and reliable, and facilitates disassembly and assembly of the face frame 1 and the front cover plate 42.

Figure 23:
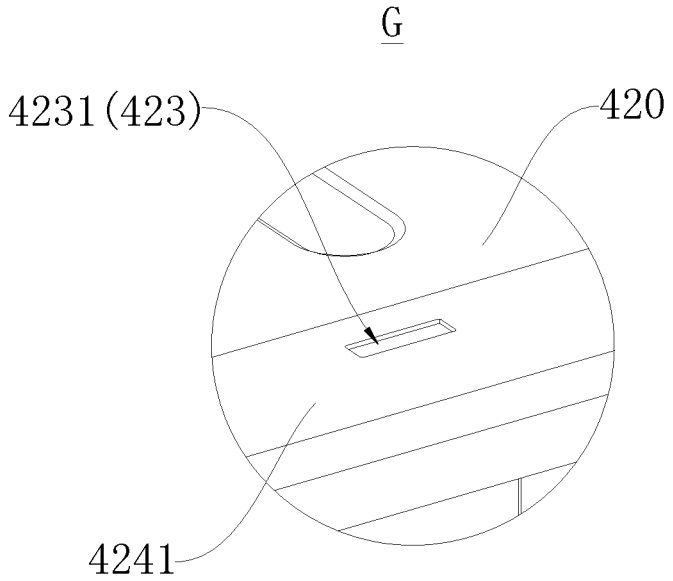
FIG. 23 is an enlarged view of a circled portion G in FIG. 22.

In some embodiments of the present application, as shown in FIGS. 21 and 23, the first engaging member 18 is configured as an engaging rib 181 provided at the inner peripheral wall of the face frame 1, and the second engaging member 423 is configured as an engaging hole 4231 provided at the front cover plate 42, thus having a simple structure and facilitating implementation.

Specifically, referring to FIGS. 21 and 23, the engaging rib 181 protrudes out of the inner peripheral wall of the face frame 1, the engaging hole 4231 penetrates through the front cover plate 42, and when the face frame 1 is mounted at the front cover plate 42, the engaging rib 181 is clamped in the engaging hole 4231, thus preventing the face frame 1 from being separated from the front cover plate 42.

It is understood that the first engaging member 18 may also be configured as the engaging hole 4231, and the second engaging member 423 is configured as the engaging rib 181. Certainly, the first and second engaging members 18, 423 may also have other structural forms which are not limited in the present application.

In some embodiment of the present application, as shown in FIG. 21, a rear surface of the engaging rib 181 is formed as a guide surface 1811, and in a direction from rear to front, the guide surface 1811 extends obliquely towards a direction close to a center line of the face frame 1 extending in a front and rear direction. Thus, when the face frame 1 is mounted at the front cover plate 42, the engaging rib 181 may be snapped into the engaging hole 4231 conveniently.

Specifically, for example, referring to FIG. 21, taking the engaging rib 181 at the first flange plate 171 of the flanging plate 17 as an example, the rear surface of the engaging rib 181 serves as the guide surface 1811, and in the direction from rear to front, the guide surface 1811 slants downwards close to the center line of the face frame 1, the center line extending in the front and rear direction. In the practical application, when the face frame 1 is mounted at the front cover plate 42, in a process of pushing the face frame 1 to move backwards, due to the arrangement of the guide surface 1811, the engaging rib 181 may abut against the front cover plate 42 and lift the flanging plate 17 of the face frame 1 smoothly until the engaging rib 181 is clamped into the engaging hole 4231.

In some embodiments of the present application, as shown in FIG. 22, a part of the front cover plate 42 protrudes in a direction close to or away from the center line of the face frame 1, so as to form a protuberance 424, the center line extends in the front and rear direction, and the second engaging member 423 is provided at the protuberance 424. The arrangement of the protuberance 424 may, on the one hand, increase a structural strength of the front cover plate 42, and on the other hand, reduce a fit clearance between the front cover plate 42 and the face frame 1 when the first engaging member 18 is in snap fit with the second engaging member 423, which improves an assembly effect of the window air conditioner 1000.

In the specific application, the front cover plate 42 is integrally formed. During practical production, the front cover plate 42 is configured as a sheet metal part, and the protuberance 424 may be formed by stamping, thus having a simple processing technology and facilitating volume production.

Optionally, for the front cover plate 42, the protuberance 424 is provided at at least one of the horizontal plate 420, the first side plate 421, or the second side plate 422.

Specifically, in some embodiments, referring to FIG. 22, the protuberance 424 includes a first protuberance 4241, a second protuberance 4242 and a third protuberance 4243, a part of the horizontal plate 420 protrudes upwards to form the first protuberance 4241, a part of the first side plate 421 protrudes leftwards to form the second protuberance 4242, a part of the second side plate 422 protrudes rightwards to form the third protuberance 4243, and the second engaging member 423 is provided at the first, second and third protuberances 4241, 4242, 4243 respectively, thereby further increasing the overall strength of the front cover plate 42.

In some embodiments of the present application, referring to FIGS. 22 and 23, the first protuberance 4241 is provided with a plurality of the second engaging members 423 spaced apart from each other in the left and right direction. Correspondingly, the first flange plate 171 is provided with a plurality of the first engaging members 18 spaced apart from each other in the left and right direction, and the plurality of first engaging members 18 are fitted with the plurality of second engaging members 423 in one-to-one correspondence, thereby increasing an assembly reliability of the face frame 1 and the front cover plate 42.

In some embodiments of the present application, as shown in FIG. 20, the window air conditioner 1000 further includes an air duct member 43 having an air flow channel formed and being located in the indoor mounting space, and thus, the air duct member 43 may guide air flow of the window air conditioner 1000.

In the practical application, the air duct member 43 is configured as a foam part, and thus is convenient to process and mould; moreover, a foam material also has characteristics of a light weight, heat insulation, sound absorption, vibration reduction, or the like, which facilitates reduction of a whole weight, work noises and production costs of the window air conditioner 1000. Certainly, an air duct may also be made of other materials which are not limited in the present application.

When mounted in the indoor mounting space, the air duct member 43 is connected with an inner surface of the front cover plate 42, and thus, the front cover plate 42 may support and protect the air duct member 43 to some extent, which facilitates an increase in an overall structural strength.

In the description of the present specification, reference throughout this specification to "an embodiment," "some embodiments," "example" or "some examples" means that a particular feature, structure, material, or characteristic described in connection with the embodiment or example is included in at least one embodiment or example of the present application. In the specification, the schematic expressions to the above-mentioned terms are not necessarily referring to the same embodiment or example. Furthermore, the described particular features, structures, materials, or characteristics may be combined in any suitable manner in one or more embodiments or examples.

Although embodiments of the present application have been shown and illustrated, it shall be understood by those skilled in the art that various changes, modifications, alternatives and variants without departing from the principle and idea of the present application are acceptable. The scope of the invention is defined by the claims and its equivalents.

What is claimed is:

1. A window air conditioner comprising:

a main unit including:

a chassis; and a front cover plate provided at a front portion of the chassis and located above the chassis, the front cover plate and the chassis forming an indoor mounting space; and a face frame detachably mounted at a front side of the front cover plate to close over an opening of a front side of the indoor mounting space;

wherein:

the front cover plate includes:

a horizontal plate located above the chassis and spaced apart from the chassis;

a first side plate extending vertically and including an upper end connected with a left end of the horizontal plate and a lower end connected with a left side wall of the chassis; and a second side plate provided opposite to the first side plate and including an upper end connected with a right end of the horizontal plate and a lower end connected with a right side wall of the chassis; and the indoor mounting space is enclosed by the second side plate, the first side plate, the horizontal plate, and the chassis.

2. The window air conditioner according to claim 1, wherein the face frame includes:

a main vent;

a plurality of auxiliary vents having different sizes and disposed at a lower side of the main vent, where the main vent and the plurality of auxiliary vents are for air ventilation in parallel; and a plurality of first snap joint members located at two opposite sides of the main vent;

the window air conditioner further comprising:

a face plate including:

an air hole in communication with the main vent; and a plurality of second snap joint members distributed at two opposite sides of the face plate and arranged centrosymmetrically, the plurality of second snap joint members being configured to be fitted with the plurality of first snap joint members in one-to-one correspondence.

3. The window air conditioner according to claim 2, wherein each of the second snap joint members includes an elastic hook configured to be hooked on a corresponding one of the first snap joint members.

4. The window air conditioner according to claim 2, wherein:

the face frame includes a plurality of first positioning members;

the face plate includes a plurality of second positioning members at two opposite sides of the face plate and arranged centrosymmetrically; and the plurality of first positioning members and the plurality of second positioning members are positioned and configured to be fitted in one-to-one correspondence to position and mount the face plate at the face frame.

5. The window air conditioner according to claim 4, wherein each of the first positioning members includes a fitting groove formed in the face frame, and each of the second positioning members extends into the corresponding fitting groove.

6. The window air conditioner according to claim 4, wherein for each first positioning member and a corresponding second positioning member, at least one of a surface of the first positioning member in contact with the corresponding second positioning member or a surface of the corresponding second positioning member in contact with the first positioning member includes a contact convex rib.

7. The window air conditioner according to claim 4, wherein the second snap joint members are provided at an upper side and a lower side of the face plate, and the second positioning members are provided at a left side and a right side of the face plate.

8. The window air conditioner according to claim 2, wherein:

the face frame includes a plurality of first limiting members centrosymmetrically distributed at two opposite sides of the face frame; and the face plate includes a plurality of second limiting members configured to be fitted with the plurality of first limiting members in one-to-one correspondence to limit displacement of the face plate.

9. The window air conditioner according to claim 8, wherein each of the first limiting members includes a limiting protrusion, each of the second limiting members includes a limiting groove provided in the face plate, and the limiting protrusion is configured to extend into the limiting groove and abut against an inner wall of the limiting groove.

10. The window air conditioner according to claim 8, wherein at least two of the first limiting members include abutting protrusions facing the face frame directly, and a space for inserting a filter is formed between the face frame and the abutting protrusions.

11. The window air conditioner according to claim 2, wherein:

two or more of the plurality of first snap joint members are located at each of the two opposite sides of the main vent; and two or more of the plurality of second snap joint members are located at each of the two opposite sides of the face plate.

12. The window air conditioner according to claim 2, wherein:

the plurality of auxiliary vents include:

a middle auxiliary vent having a first size; and two side auxiliary vents arranged at two sides of the middle auxiliary vent, respectively, the two side auxiliary vents having a second size, and the first size being smaller than the second size.

13. The window air conditioner according to claim 1, wherein the face frame includes a first engaging member at an inner peripheral wall of the face frame, and the front cover plate includes a second engaging member in snap fit with the first engaging member.

14. The window air conditioner according to claim 13, wherein the first engaging member includes an engaging rib provided on the inner peripheral wall of the face frame, and the second engaging member includes an engaging hole provided in the front cover plate.

15. The window air conditioner according to claim 14, wherein a rear surface of the engaging rib includes a guide surface extending obliquely in a direction from rear to front towards a direction towards a center line of the face frame, the center line extending in a front and rear direction.

16. The window air conditioner according to claim 13, wherein the front cover plate further includes a protuberance protruding in a direction towards or away from a center line of the face frame extending in a front and rear direction, the second engaging member being provided on the protuberance.

17. The window air conditioner according to claim 16, wherein:

the protuberance is a first protuberance formed at the horizontal plate and protruding upwards, and the second engaging member is one of a plurality of second engaging member of the front cover plate;

the front cover plate further includes:

a second protuberance formed at the first side plate and protruding leftwards;

a third protuberance formed at the second side plate and protruding rightwards; and each of the second protuberance and the third protuberance is provided with one of the second engaging members.

18. The window air conditioner according to claim 1, wherein the front cover plate is an integrally formed part or a sheet metal part.

19. The window air conditioner according to claim 1, further comprising:

an air duct member including an air flow channel and located in the indoor mounting space.

* * * * *